United States Patent [19]

Bloeck et al.

[11] 4,333,582

[45] Jun. 8, 1982

[54] GROOVED BEVERAGE CAN LID

[75] Inventors: Siegfried Bloeck; Erich Höfling, both of Kreuzlingen; Rudolf Lüthi, Niederwangen; Werner Diemi, Bern, all of Switzerland

[73] Assignee: Swiss Aluminium Ltd., Chippis, Switzerland

[21] Appl. No.: 193,796

[22] Filed: Oct. 3, 1980

[30] Foreign Application Priority Data

Oct. 16, 1979 [CH] Switzerland ..... 9282/79

[51] Int. Cl.[3] ..... B65D 6/34; B65D 8/04; B65D 41/02

[52] U.S. Cl. ..... 220/66; 220/266

[58] Field of Search ..... 220/265–273, 220/66

[56] References Cited

U.S. PATENT DOCUMENTS 3,432,067 3/1969 Khoury ..... 220/273

3,554,400 1/1971 Bozek ..... 220/273

*Primary Examiner*—George T. Hall

*Attorney, Agent, or Firm*—Bachman and LaPointe

[57] ABSTRACT

The pre-fabricated pouring outlet in a lid for cans containing carbonated drinks lies basically at an angle of 0° or 90° to the rolling direction of the sheet from which the lid is made. The surface of the lid features at least one ring-shaped stiffening groove which points towards the can interior, is concentric with the periphery of the lid and is interrupted in the region of the pouring outlet. The diameter of the groove is 65–80% of that of the nominal diameter of the can.

The stiffening groove raises the resistance of the lid towards pressure from inside the can by about 10%. This means that, when manufacturing a lid which has to withstand a specific pressure from inside the can, and using the same material, the thickness of the lid can be reduced to save material.

11 Claims, 4 Drawing Figures

GROOVED BEVERAGE CAN LID

BACKGROUND OF THE INVENTION

The present invention relates to an aluminum can lid which is able to withstand pressure, having a pre-shaped opening or outlet in the lid surface and a ring-shaped groove at the transition from the lid surface to lid edge, the said lid being for cans containing carbonated drinks i.e. drinks containing carbon dioxide.

To improve the ability of a can lid, for example a lid on a can filled with a carbonated drink, to resist a relatively high pressure from within, a ring-shaped groove is usually provided at the transition between the lid surface and the lid edge. Also known, from the U.S. Pat. No. 3,417,898, is a lid without opening which features on the lid surface an outward domed, ring-shaped groove for further strengthening.

Increasing the resistance of the can lid to pressure from within is of economic interest inasmuch as the required ability to withstand such pressure can then be achieved with lids made from thinner sheet material.

It is therefore the principle object of the present invention to develop a can as set forth above characterized by improved ability to withstand pressure.

SUMMARY OF THE INVENTION

The foregoing object is achieved by way of the present invention wherein the opening for pouring lies at an angle of 0° or 90° to the rolling direction of the sheet from which the lid is made and the surface of the lid features at least one ring-shaped strengthening groove which is concentric with the periphery of the lid, points towards the interior of the can and is interrupted in the region of the opening for pouring out the contents, the diameter of the said groove being 65 to 80% of the diameter of the can.

It has been found that with increasing inner pressure there is initially a continuously increasing doming of the surface of the lid which, when overloading occurs, suddenly becomes a permanent, oriented bulge in the form of a buckle—referred to in the following as buckling. This buckling has proved to be a suitable criterion for determining the ability of a lid to withstand pressure from inside the can. It has also been noted that the buckling occurs preferably in the direction 45° to the rolling direction of the can lid sheet, which apparently is related to the rolling texture of this sheet.

If the opening for pouring is aligned at about 0° or 90° to the rolling direction, and all 45° directions intersected by a stiffening groove pointing towards the interior of the can, then the resistance of the lid to pressure from inside is increased by about 10%. Therefore, when manufacturing a lid which is required to resist a certain pressure from inside, the thickness of the same sheet material can be reduced. With the present day mass production of cans this leads to a significant savings in material.

The surface of the lid can be provided with two stiffening grooves. However, a lid with one single stiffening groove of diameter equal to 70–77% of the nominal diameter of the can has been found to be particularly advantageous.

The depth and the radius of curvature of the stiffening groove are, advantageously, between 0.5 and 1.5 mm, preferably between 0.8 and 1.3 mm.

The outlet for pouring can be closed off with a sealed-on, tear-off strip made of aluminum, whereby the sealing-on of the said strip usefully takes place before pressing the stiffening groove into the lid. The outlet for pouring can, however, also be pre-made by providing an embossed line, such as is found for example with the so-called ring-pull closure. In this case the stiffening groove is usefully pressed into the lid before the tear line is embossed onto the lid.

The invention is described in greater detail hereinbelow with the help of schematic drawings, and the advantages gained therewith demonstrated by way of an example.

DETAILED DESCRIPTION

Figure 1:
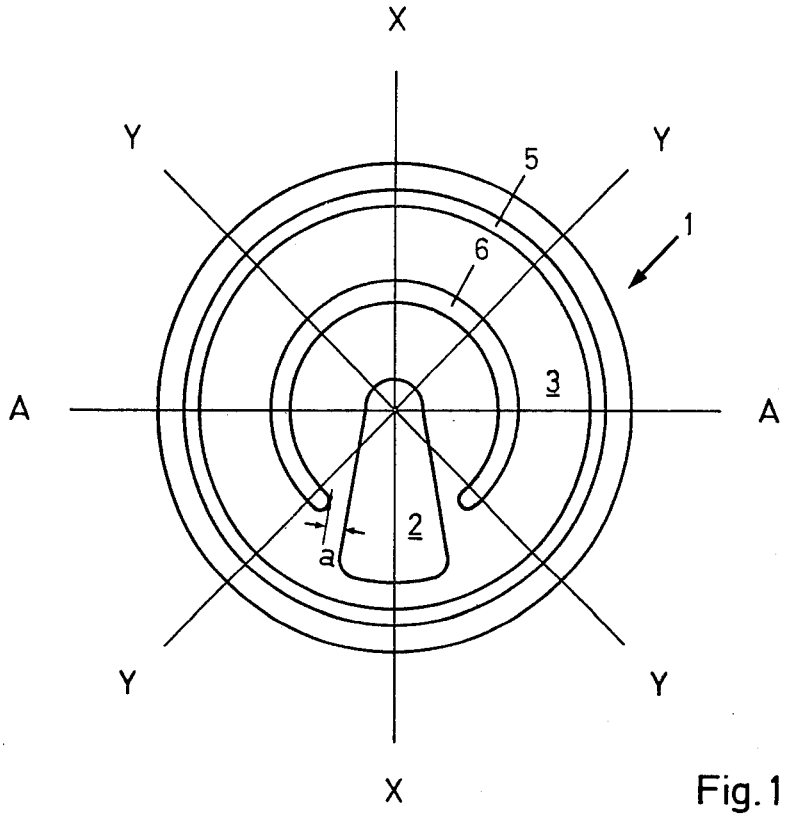
FIG. 1: Is a plan view of a lid.
Figure 2:
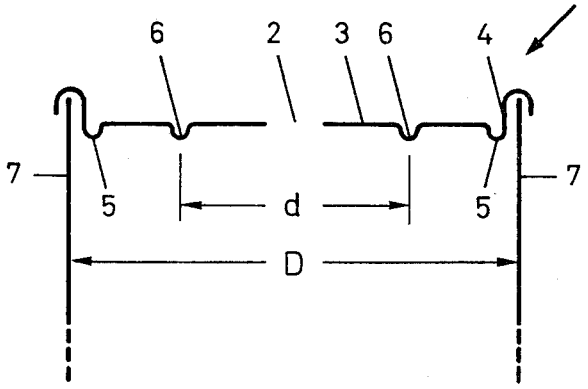
FIG. 2: Is a cross sectional view taken along line A—A of the lid shown in FIG. 1.
Figure 3:
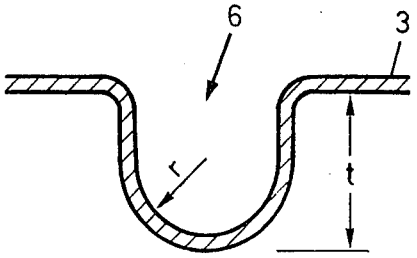
FIG. 3: Is an enlarged detail of the stiffening groove in FIG. 2.

The lid 1 with the opening 2 for pouring lying in the rolling direction x is provided with a ring-shaped groove 5 at the transition between the lid surface 3 and inner edge 4 of the lid 1, to provide strengthening. To increase the resistance to pressure from inside the can further, the lid surface 3 features a ring-shaped stiffening groove 6 which points towards the interior of the can and which is concentric with groove 5. The groove 6 is interrupted in the region of the opening 2 for pouring. The distance "a" between the interrupted stiffening groove 6 and the edge of the pouring outlet 2 is about 3 to 5 mm. This distance "a" is, however, not critical inasmuch as the only thing which must be observed is that the 45° directions "y" must be intercepted completely by the groove 6.

To specify the position of the groove 6 unambiguously, its diameter d is expressed as a ratio of the nominal diameter D of the can body 7. The shape of the stiffening groove 6 is given by the radius of curvature r and depth t.

EXAMPLE

Lids for cans of nominal diameter 63 mm were prepared from 0.33 mm thick sheet of an aluminum alloy containing basically 2.8% magnesium and 0.3% manganese. A ring-shaped groove of depth 1.7 mm and radius 0.8 mm was provided at the transition from the lid surface to the lid edge. A pouring outlet was stamped out in the direction of rolling, an aluminum tear-off strip sealed over it and then a stiffening groove of depth 1.0 mm and radius 1.0 mm pressed into the lid.

The lids were flanged onto can bodies. The pressure inside the can was increased by compressed air fed in via a fitment attached to the can body wall. The pressure was increased until buckling took place. The buckling no longer formed at an angle of 45° to the rolling direction, but between the interrupted stiffening groove and the edge of the pouring outlet.

Figure 4:
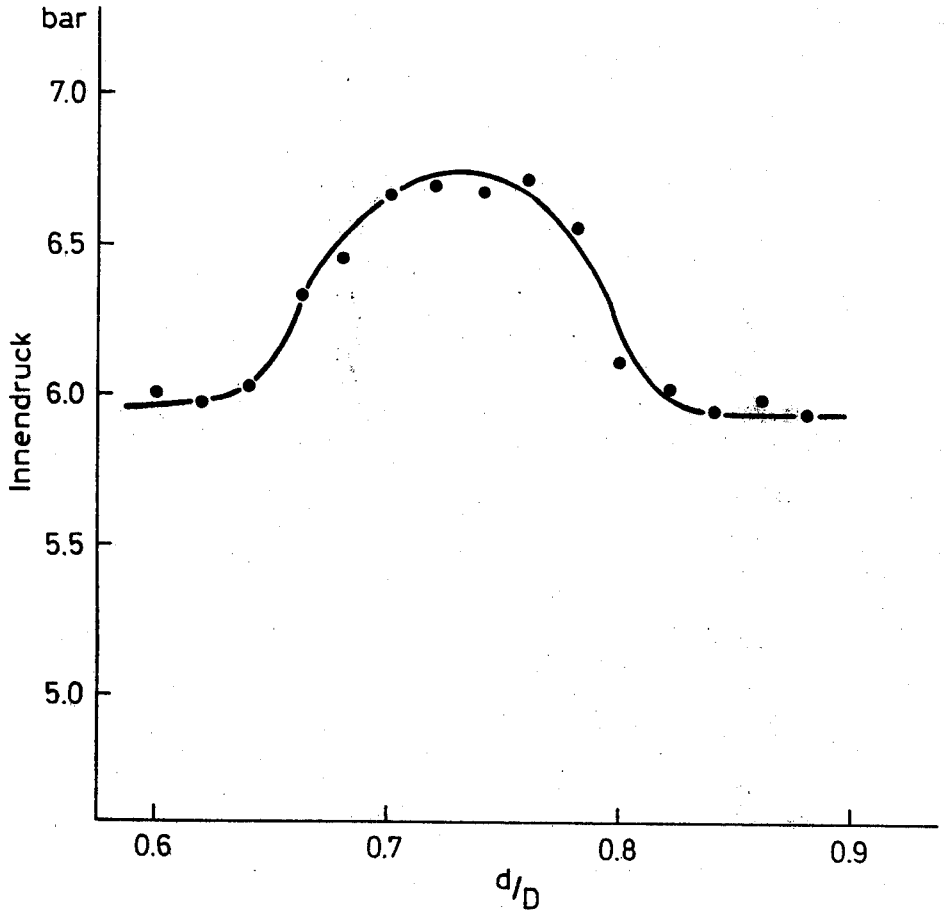
FIG. 4: Is a chart showing the critical pressure for permanent bulging to occur as a function of the diameter of the stiffening groove.

The critical pressure at which this permanent bulging took place is presented in FIG. 4 as a function of the ratio d/D for various diameters of stiffening grooves on lids for cans of 63 mm nominal diameter. The measured values entered there are average values from three tests. It can be seen from this diagram that the resistance of a lid to pressure from inside can be increased by more than 10% by the provision of the stiffening grooves.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container lid for pressurized sealed containers comprising a top surface having a removable portion, said removable portion being located at an angle with respect to the rolling direction of the lid material selected from the group consisting of about 0° and 90°, said top surface further having stiffening grooves located at a 45° angle with respect to the rolling direction of the lid material wherein the strength of said lid is increased by about 10%.

2. A container lid according to claim 1 wherein said stiffening grooves comprise a ring-shaped stiffening groove which is interrupted in the region of said opening.

3. A container lid according to claim 2 wherein said ring-shaped stiffening groove is concentric with the periphery of said lid.

4. A container lid according to claim 2 wherein said lid is provided with a plurality of ring-shaped stiffening grooves.

5. A container lid according to claim 1 wherein said top surface is provided with a ring-shaped groove at the transition from said top surface to the edge of the lid.

6. A container lid according to claim 2 wherein said ring-shaped stiffening groove has a diameter of about 65% to 85% of the diameter of the can.

7. A container lid according to claim 2 wherein said ring-shaped stiffening groove has a diameter of about 70% to 77% of the diameter of the can.

8. A container lid according to claim 2 wherein said ring-shaped stiffening groove has a depth of about 0.5 mm to 1.5 mm.

9. A container lid according to claim 2 wherein said ring-shaped stiffening groove has a depth of about 0.8 mm to 1.3 mm.

10. A container lid according to claim 2 wherein said ring-shaped stiffening groove has a radius of curvature of about 0.5 mm to 1.5 mm.

11. A container lid according to claim 2 wherein said ring-shaped stiffening groove has a radius of curvature of about 0.8 mm to 1.3 mm.

* * * * *